US005664274A

United States Patent [19]

Collins

[11] Patent Number: 5,664,274

[45] Date of Patent: Sep. 9, 1997

[54] MULTI-PURPOSE TOOL

[76] Inventor: Michael Collins, 3075 Batesville Rd., Woodstock, Ga. 30188

[21] Appl. No.: 395,616

[22] Filed: Feb. 28, 1995

[51] Int. Cl.[6] ..... B25B 7/22

[52] U.S. Cl. ..... 7/129; 7/167; 81/423; 81/427.5; 81/177.85; 81/177.4; 81/180.1; 224/904

[58] Field of Search ..... 7/118, 125–134, 7/138, 142, 158, 165, 167; 81/419–424, 900, 427.5, 177.1, 177.2, 177.4, 177.85, 180.1, 181, 185.2, 489–490; 224/191, 242, 147, 153, 268, 270, 904

[56] References Cited

U.S. PATENT DOCUMENTS

| | | | |
|---|---|---|---|
| 589,392 | 8/1897 | Kolar . | |
| 753,048 | 2/1904 | Des Moineaux | 81/427.5 X |
| 2,057,201 | 10/1936 | McCluskey . | |
| 2,325,035 | 7/1943 | Cargile | 7/125 X |
| 2,606,471 | 8/1952 | Kollweck . | |
| 2,729,127 | 1/1956 | Watanabe | 7/142 X |
| 4,238,862 | 12/1980 | Leatherman . | |
| 4,744,272 | 5/1988 | Leatherman . | |
| 4,830,247 | 5/1989 | Banks | 224/904 X |
| 4,951,857 | 8/1990 | Carr | 224/242 X |
| 5,062,173 | 11/1991 | Collins et al. . | |
| 5,142,721 | 9/1992 | Sessions et al. . | |
| 5,212,844 | 5/1993 | Sessions et al. . | |
| 5,232,136 | 8/1993 | Unger | 224/904 X |
| 5,259,277 | 11/1993 | Zurbuncen | 81/900 X |
| 5,267,366 | 12/1993 | Frazer . | |
| 5,396,820 | 3/1995 | Baker | 81/177.85 X |
| 5,477,758 | 12/1995 | Cunningham | 81/177.85 |

FOREIGN PATENT DOCUMENTS

| | | | |
|---|---|---|---|
| 2649350 | 1/1991 | France | 7/127 |

*Primary Examiner*—D. S. Meislin

*Attorney, Agent, or Firm*—Leatherwood Wakder Todd & Mann, P.C.

[57] ABSTRACT

A multi-purpose tool having a pincer-head implement which may be detached from the handles of the tool. The handles are provided with multiple implements, such as screwdrivers, files, blades, or the like, which are slidable between a retracted position, within the handles, to an extended position, extending outwardly from the handles. The handles may be detached from the pincer-head, if desired, when a handle implement is being used. Alternately, the handle implements can be used while the handles are attached to the pincer-head implement. Different pincer-head implements may be provided with the handles, including pliers, shears, wrenches, scissors, and the like. The handles are each provided with a receiver for receiving the free ends of the pincer implement, and the receiver may also be used to receiver socket-type tools, such that the handle acts as a socket, or other tool driver. Locking members are provided for locking the pincer implement to the handles and for locking the handle implements in extended and retracted positions.

3 Claims, 7 Drawing Sheets

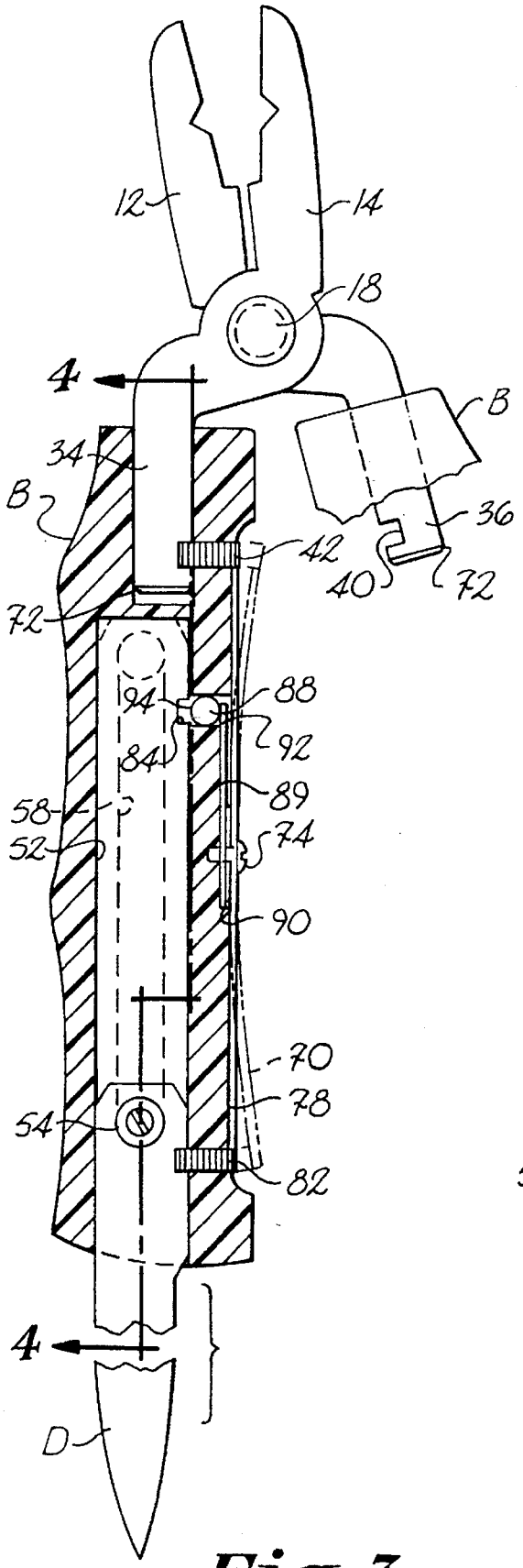
Fig. 3.
Fig. 4.
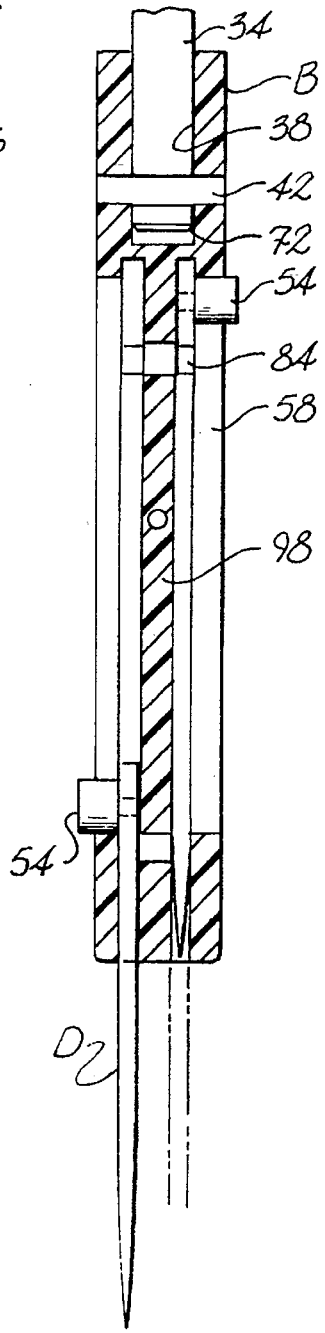

MULTI-PURPOSE TOOL

BACKGROUND OF THE INVENTION

This invention relates generally to a multi-purpose hand tool having a pliers-type head and detachable handles with extendable tools therein.

Hand tools having multiple implements are enjoying increasing popularity. The advantage of such tools are that they typically provide several tool implements, such as screwdrivers, knife blades, files, pliers, and the like in a single folding unit. Perhaps, the best known of these tools is the Leatherman® tool, manufactured by the Leatherman Tool Company of Portland, Oreg. Other popular multiple function tools are made by Gerber Legendary Blades, also of Portland, Oreg., and SOG Specialty Knives of Edmonds, Wash. By providing numerous tools in one compact embodiment, the devices can be carried by a user in his or her pocket, worn on their belt, or kept in a tool box, glove compartment, tackle box, etc. This eliminates the need for a collection of conventional tools, which would normally be carried in a tool box, tool pouch, or other container. This configuration is particularly useful for those users who may have only an infrequent need for certain tools, which would not warrant carrying those tools in their regular, full-size form (such as screwdrivers, pliers, or the like).

However, multiple tool devices currently available do have their limitations. For example, certain tool units have plier heads which fold into the handles of the device when not in use. To actually use the plier head, or cutters provided thereon, is pivoted outwardly from the handles of the device. This requires additional time and dexterity, and may be made more difficult when the user's fingers are cold, when the user is wearing gloves, or when the user has some debilitating problem with his or her hands. Further, the user must exercise care to not be pinched as the pincer-type plier head is withdrawn from the handles and folded out to an extended operational state. Another drawback can be that when the plier head is in the extended, operational state, and used by the user, the flesh of the user's hand may come into contact with open portions or flanges of the handle, or the actual implements therein, which reduces the comfort in using the tool.

Multiple tool devices may also include tool implements which pivot outwardly from each of the device's handles. Because these tools pivot outwardly from the handles, the handles are often required to be at least partially pried apart from one another in order to pivot the tools in the handles outwardly to an extended position for use. Again, this requires the work of actually moving the handles apart from one another, pivoting the tools outwardly, and then, generally, closing the handles back together to provide a more comfortable grip. As discussed above in regards to extracting the pliers head from the folded position, extracting the tool implements from the handles requires dexterity of the user's fingers, and is, again, potentially made more difficult in cold environments and/or when the user is wearing gloves.

Moreover, when using the implements extending from the handles, for example, when a screwdriver implement is being used, the user must hold and rotate the whole tool in order to turn a screw. This reduces the symmetry which may be preferred in turning a screw as the screwdriver blade would typically be off-center from the line of rotation of the tool, in addition to the handles of the tool not being centered about the screwdriver. What results is a screwdriver that may be somewhat awkward to use.

Multiple implement tools have been patented, and include U.S. Pat. Nos. 4,238,862 and 4,744,272, both issued to Leatherman. These patents disclose multiple use tools having a pliers head which is folded between two handle portions. The handle portions include tool implements which may be pivoted outwardly from the handles when the handles are spread apart and opened.

U.S. Pat. No. 5,062,173, issued to Collins, et al. (one of the inventors thereof being the inventor of the present invention), discloses a multi-function tool wherein tool implements may be pivoted outwardly from the tool handles whether or not the handles are spaced apart from one another.

U.S. Pat. No. 5,267,366, issued to Frazer, discloses a combination hand tool having a plier head and tool implements which pivot outwardly from the handles, when the handles are spread apart from one another.

U.S. Pat. Nos. 5,212,844 and 5,142,721, both having been issued to Sessions, et al., also discloses a multi-implement tool, wherein the plier jaws are attached to a pair of handles for sliding movement with respect to the handles. The handles also include tool implements which may pivot outwardly when the handles are spread apart.

While the foregoing designs are known, there still exists a need for a multi-purpose hand tool having comfortable handles and a plurality of easy-to-use tools. Such a multi-purpose would ideally be of rugged construction and versatile enough to allow for a scissors-type action for pliers, cutting tools, wrenches, and the like, while at the same time, would offer tools which may be selectively fixed into place for operation. Additionally, the preferred multi-purpose tool would offer removable handles for increasing ease and efficiency of use and would also have detachable pincer-type heads for connection to the handles. Furthermore, compact means would be provided for transporting and storing the tool in either a disassembled or fully assembled state.

SUMMARY OF THE INVENTION

It is, therefore, the principal object of this invention to provide a multi-purpose tool having interchangeable components.

It is another object of the present invention to provide a multi-purpose tool having a pincer-type implement selectively removable from two handles.

It is another object of the present invention to provide a multi-purpose tool having handles with tool implements provided therein for longitudinal sliding movement with respect to the tool handles.

It is yet another object of the present invention to provide a multi-purpose tool having handles which can be detached and which have tools therein, which, together with the detached handle, can be used individually.

It is still another object of the present invention to provide a multi-purpose tool having handles with implements therein, wherein the implements can be extended from the handles without spreading the handles apart from one another.

It is yet another object of the present invention to provide a multi-purpose tool, having handles with tool implements therein, wherein the tool implements can be locked in an extended position.

It is still another object of the present invention to provide a multi-purpose tool having handles defining a socket end thereof to allow the handle to be used as a driver for socket tools.

It is still another object of the present invention to provide a sheath for carrying a multi-purpose tool constructed in accordance with the present invention.

A further object of the present invention is to provide a multi-purpose tool having ergonomic handles with closed, contoured surfaces to improve comfort in using the tool.

Another object of the present invention is to provide a multipurpose tool with electrically insulated handles.

It is a further object of the present invention to provide a multi-purpose tool having handles with implements extendable outwardly therefrom and a locking device for automatically locking the implements when moved to an extended position.

Generally, the present invention includes a hand tool comprising two elongated handle members, each having a first end and a second end opposite the first end. The first end of each handle member defines an implement receiver and the second end of each handle member defines an implement passage. The handle members also define implement compartments in communication with the implement passages.

A pincer implement is provided having first and second outwardly extending free ends, each of the first and second free ends being receivable in a respective one of the implement receivers of the handle members.

At least one spring-biased locking member is associated with each of the implement receivers for selectively locking each of the first and second free ends of the pincer implement in a respective one of the implement receivers, such that upon receipt of the first and second free ends in the implement receivers, the handle members are movable for operating the pincer implement.

At least one sliding implement is carried for sliding movement in the implement compartments of the handle members and can be moved between an extended position, extending through the implement passages of the handle members outwardly from the handle members for use, and a retracted position, substantially within the handle members. Additionally provided is at least one spring-biased locking member associated with the handle members for selectively locking the sliding implements in the extended and retracted positions.

The present invention also includes sheaths which can be used to carry a multi-purpose tool constructed in accordance with the present invention either in an assembled configuration, wherein the pincer implement is connected to the handles, or in a partially disassembled configuration, wherein the pincer implement is detached from the handle members.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which:

FIG. 3 is a sectional view taken along lines 3—3 of FIG. 2;

FIG. 4 is a sectional view taken along lines 4—4 of FIG. 3;

DESCRIPTION OF THE PREFERRED EMBODIMENT

Figures 1, 2:
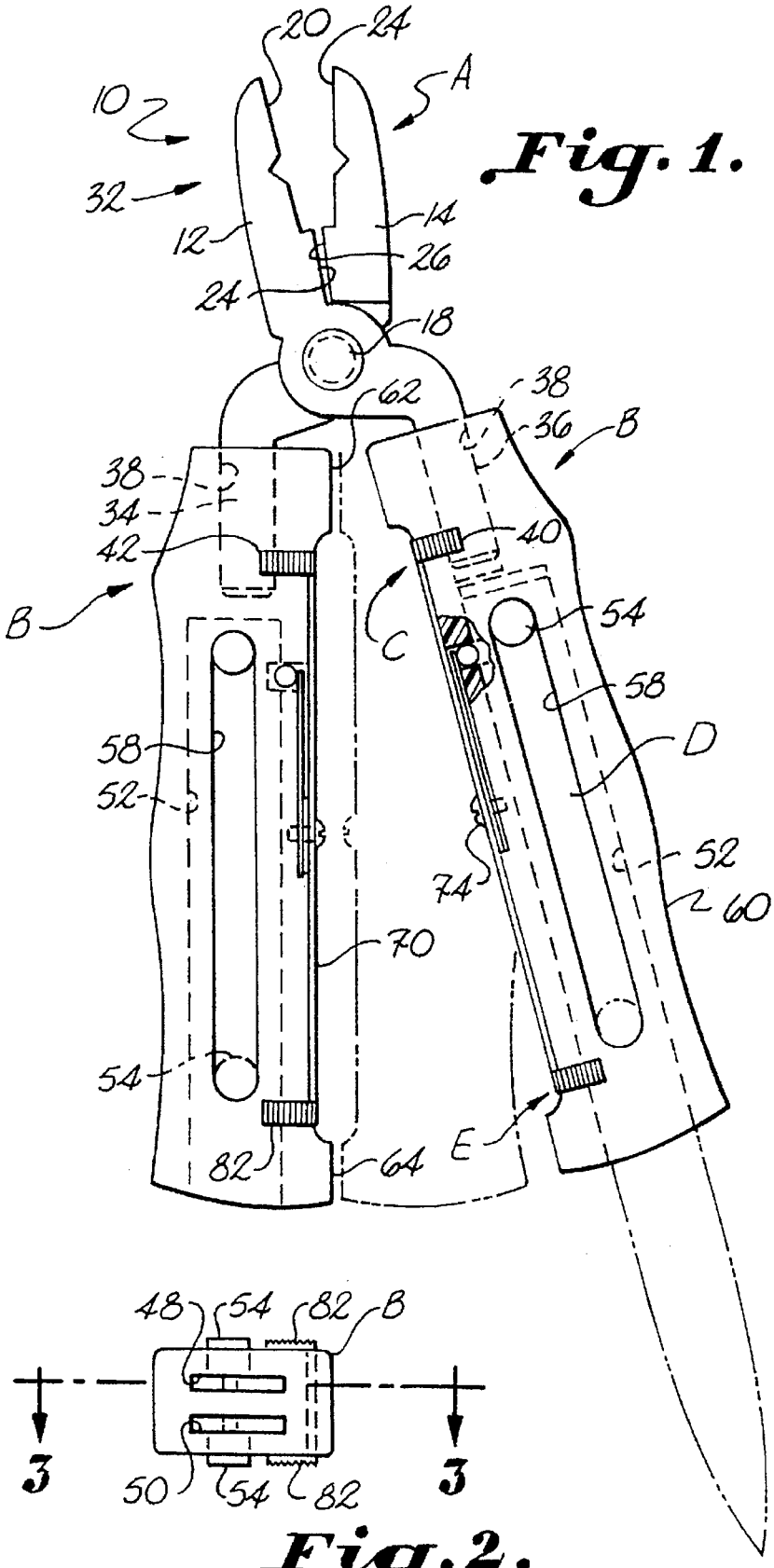
FIG. 1 is a plan view of a multi-purpose tool constructed in accordance with the present invention.
FIG. 2 is an end view of a handle of a multi-purpose tool constructed in accordance with the present invention.

The accompanying drawings and the description which follows set forth this invention in its preferred embodiment. However, it is contemplated that persons generally familiar with hand tools and knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the multi-purpose tool of the present invention is indicated generally in the figures by reference character 10.

Turning to FIG. 1, the multi-purpose tool 10 of the present invention includes a pincer implement, generally A; handle members, generally B; locking means, generally C, for selectively locking the pincer implement A to handles B; handle implements, generally D, which slide into and outwardly from handles B; and locking means, generally E, which lock the handle implements D in extended and retracted positions.

Pincer implement, or pliers head A, includes two jaws 12, 14 which pivot with respect to one another about a pivot shaft 18. While placer implement A is illustrated as having pliers gripping surfaces 20, 22 and cutting surfaces 24, 26, it is to be understood that pincer implement A could be any of a variety of devices, and could include scissors, wire cutters, forceps, or the like (not shown), and is not to be limited to the pincer embodiment illustrated in the drawings.

Jaws 12, 14 each include a working end, generally 32, and a free end, generally 34. Free ends 34, 36 are preferably of rectangular, octagonal, square, or some other cross sectional shape for mating receipt within implement receiver receptacles 38, which are provided in handles B, in a manner to be discussed in more detail below. Free ends 34, 36 of pliers A include notches 40 which are engaged by locking means C to attach pliers A to handles B. While a notch 40 has been indicated as a recess which is engaged by locking means C, it is to be understood that a variety of other profiles or locking arrangements could also be used other than the notch/spring tab 42 arrangement illustrated between locking means C and free ends 34, 36, without departing from the scope of the invention. Additionally, the connection arrangement of free ends 34, 36 and receptacle 38 could be reversed, if desired, such that free ends 34, 36 could include female receivers (not shown) for receiving projections (not shown) extending from the ends of handles B, where receptacles 38 are presently disclosed.

Figure 15:
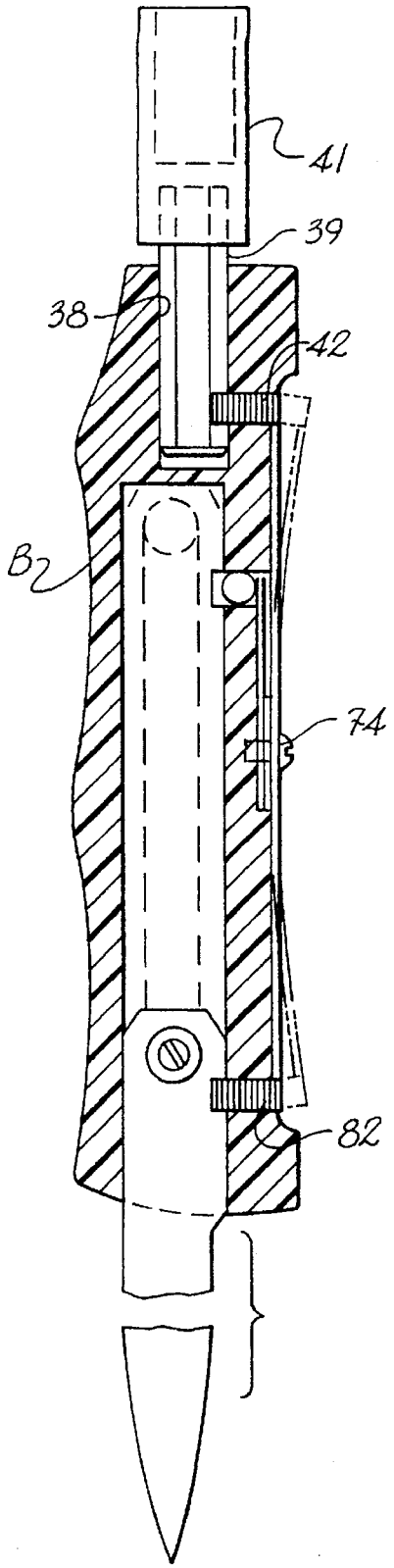
FIG. 15 is a sectional view of a handle of a multi-purpose tool constructed in accordance with the present invention.

Preferably, free ends 34, 36 of pliers A are of a cross sectional shape which matches the cross sectional shape of socket driving tools commonly available, such that receivers 38 of handles B will accept not only free ends 34, 36, but also readily available screwdriver bits, Allen wrenches, Torx drivers, or other drivers (not shown) to increase the versatility of handles B. Also, as shown in FIG. 15, receivers, or sockets, 38 of handles B could be used in connection with a commonly available adaptor 39 which could potentially be connected to socket-type wrenches 41, thereby allowing the handles to be used for turning nuts and bolts with socket tools, if desired.

FIGS. 1 through 4 illustrate in detail the construction of handles B. It is to be noted at the outset that when attached to plier head A, handles B are mirror images of one another, with locking means C and E of each handle facing one another. In actuality, handle members B are not mirror images of one another and can be switched with respect to one another to opposite free ends 34, 36 of pliers head A, if desired.

Figure 5:
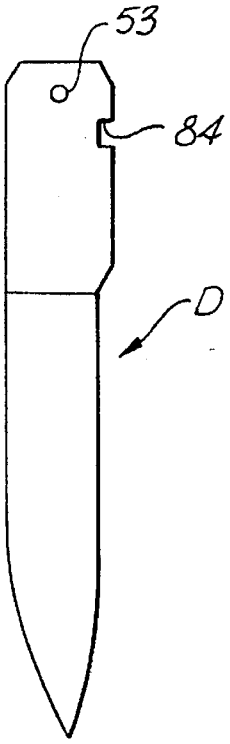
FIGS. 5 through 9 illustrate various implements which may be provided in a handle of a multi-purpose tool constructed in accordance with the present invention.
Figure 9:
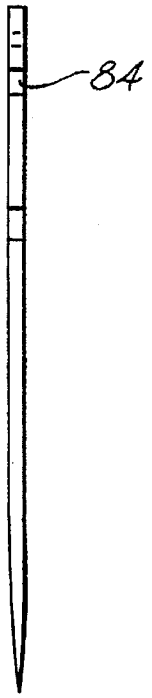
Figure 6:
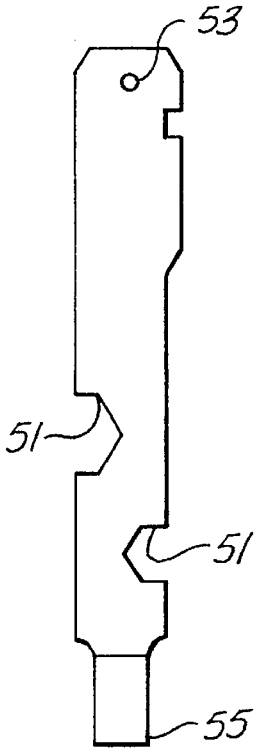
Figure 7:
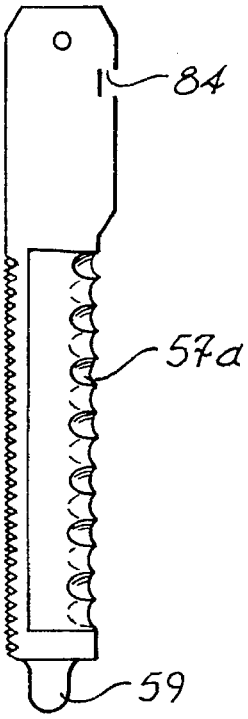
Figure 8:
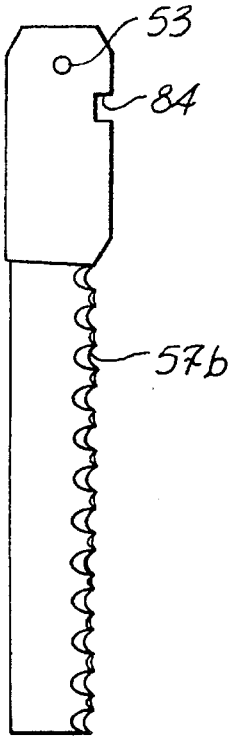

Handles B are preferably of molded material, such as glass-filled nylon, plastic, or some other suitable material. If desired, handles B could be produced of metal or wood. Handles B include at one end receivers 38, as discussed above, and at the other end, implement passages 48, 50 through which implements D pass when moved between the retracted and extended positions, as shown in FIGS. 3 and 4. Implement compartments 52 extend longitudinally in the handles and are open to implement passages 48, 50. Implements, such as those illustrated in FIGS. 5 through 9, are provided in the implement compartments for sliding movement therein. Although a variety of implements are shown in FIGS. 5 through 9, it is to be understood that such a showing is not to be exhaustive, and that numerous other implement configurations could also be used in the present invention. For example, FIGS. 5 and 9 illustrate a knife blade. FIG. 6 illustrates an implement having wrench portions 51 for turning nuts and bolts and a blade driver 55 for turning screws or for prying. FIGS. 7 and 8 illustrate implements having serrated edges 57*a*, 57*b* for sawing and cutting, and FIG. 7 also illustrates a pointed driver tip 59 which can be used for Phillips-head fasteners.

Attached to implements D is an upstanding post 54 which can be screwed, press-fit, or otherwise connected a threaded hole 53 to the implements. Preferably, the posts 54, which also act as a push button, for allowing the user to advance and retract the implements, are removably connected to the implements, such that the implements may first be inserted into the implement compartments through the implement passageways, and then the buttons 54 may be screwed into the implements to aid in restraining the implements within implement compartments of the handles. An elongated slot 58 is provided on each side of the handles for carrying the buttons 54 when the user advances the implements into and out of the handles. The implements are preferably removable from the compartments, by unscrewing buttons 54, to allow a wide variety of implements to be exchanged and used in the handles. Also, the implements can be switched from one implement compartment within a handle to another implement compartment within the same or another handle, if desired.

The handles are also preferably provided with contoured surfaces 60 on the outermost portions thereof to aid in the comfortable use of tool 10. Further, the handles preferably include forward and rearward downturned portions 62, 64, respectively, which engage one another when the handles are squeezed tightly toward one another, such that locking means C and E, respectively, do not generally contact one another when the handles are squeezed tightly together. In other words, the downturned portions 62, 64 allow for a gap 68 to remain between the handles when the handles are contacting one another. This gap 68 also serves to facilitate insertion of the user's fingers to separate the handles when the tool is being used.

Locking means C and E are illustrated in particular in FIGS. 1, 3, and 4. Locking means C and E are preferably connected to one another by a single leaf spring 70 which extends substantially the length of each handle. However, it is to be understood that individual spring-biased locking means, other than the single leaf spring, could be used instead. For example, a leaf spring (not shown) could be used for each of locking means C and E, or a coil spring could be used, if desired. Further, ball, or block detente mechanisms (not shown) could be used in lieu of the locking means C and E, or any number of other locking configurations could be used which would securely hold the pliers in one end of a handle, with regard to locking means C, and a tool implement in an extended position from the handle, with regards to locking means E.

Locking means C includes a tab member 42 which is fixedly connected to leaf spring 70. Tab 42 is pulled outwardly from a handle when a free end of the pliers is to be inserted into a handle receiver. As shown in FIG. 3, the free end could include a tapered portion 72 which automatically forces locking tab outwardly when the free end is inserted into the receiver. The tab is forced outwardly by the tapered portion until the tab clears the notch, and then, the tab is forced into the notch by a spring to automatically lock the pliers to the handle. The locking tab is then pulled away from the handle manually in order to extract the free end from the receiver, when desired. A screw 74, or other fastener, is used to attach leaf spring 70 within an elongated leaf spring recess, generally 78, provided on one side of the handle. The recess allows the leaf spring to be carried in a flush manner with respect to the inner side 80 of the handles.

Attached to the other end of the leaf spring is locking means C, which includes a locking tab 82 similar to locking tab 72. Locking tab 82 automatically engages with a notch 84 in a tool implement, such as the knife blade 86 implement as shown in FIG. 3, when the implement is in an extended position.

The notch 84 each tool implement preferably includes has a dual purpose. One such purpose has already been discussed in regards to the interaction between locking tab 82 and the notch to lock the tool implement in an extended position. However, the notch 84 has another purpose in that when the tool implement is in a fully retracted position, a ball or roller bearing 88 engages the notch 84 to maintain the implement within the handle in the retracted position. Engagement of the ball or roller bearing 88 with the notch 84 is indicated in FIGS. 1, 3, and 4. Bearing 88 is biased towards the notch 84 by a second leaf spring 89, which is held within handle recess 78 by the same fastener 74 holding the other leaf spring 70. A spacer 90 is preferably provided between the two leaf springs 70, 89 such that flexure of one leaf spring does not affect the flexure of the other. A variation of design (not shown) allows for the single leaf spring 70 to be used instead of the additional shorter leaf spring 89 such that the single leaf spring biases both locking tabs 72, 82, in addition to bearing 88.

Locking tabs 72, 82 can be constructed of metal, plastic, or some other suitable material. An advantage of constructing the tabs 72, 82 of a non-electrically conductive material such as a non-conducting plastic is that metal pincers A are insulated from handles B. This facilitates use of tool 10 for electrical applications while minimizing the potential for electric shock by the user. It is also to be noted that tabs 72, 82 could be formed together and integral with leaf spring 70, or with leaf springs 70, 89 together, if desired, to yield a unitary leaf spring-locking tabs combination (not shown). Such a combination would preferably be molded of a plastic material.

In operation, the handles are attached to the pincer implement as discussed above and are held in place within receivers in the handles by locking means C. No unfolding of the pincer head from the handles is required in order to use the pincer head. When the pincer head is attached to the handles, it is ready for use without requiring further manipulation of the device. In order to extend tool implements from the handles, a button 54 connected to the desired tool is simply pushed forward by the user such that the tool slides outwardly from the corresponding implement passage. A slight pressure applied to the button in a direction towards the implement passage causes the notch of the implement to override the pressure exerted against the notch by the leaf spring-biased bearing 88 in bearing passage 98, such that the bearing moves inwardly within bearing channel 92 to a retracted position, thereby allowing the implement to slide outwardly from the handle. The bearing, which is preferably an elongated roller bearing, may also extend into adjacent implement compartments for simultaneously locking two implements in the retracted position.

FIG. 4 illustrates extension of the bearing into adjacent compartments. The bearing is held in a divider section 98 which separates adjacent compartments and which prevents bearing 88 from falling into the implement compartment once the implement is in an extended position. Divider section 98 also allows the bearing roller 88 to pivot upwardly in one compartment, to allow movement of the implement therein to an extended position, while remaining in locking engagement with an implement in the adjacent compartment, if desired.

It is to be understood that each handle may include one or more implement compartments. Although only two implement compartments have been illustrated, additional implement compartments could be provided, if desired. For example, on one side of a handle, two implements could be provided, in a side-by-side fashion, such that there were two elongated slots and compartments side-by-side to allow for receipt of the adjacent tools. As illustrated in FIG. 4, elongated slots 58 are provided on each side of a handle and carry a button 54 for movement during actuation of the respective tools.

Figure 10:
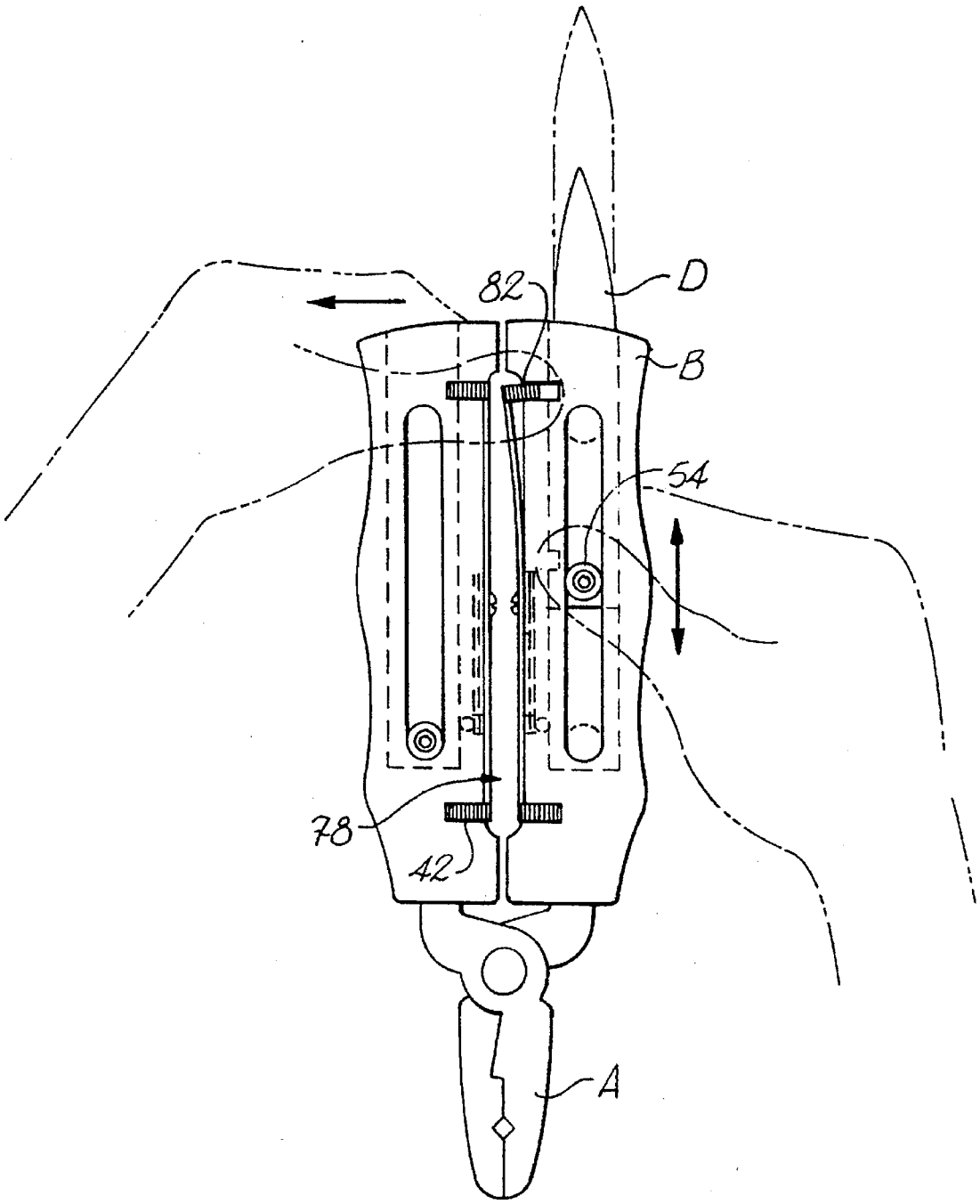
FIG. 10 is an elevational view of a multi-purpose tool constructed in accordance with the present invention illustrating a user operating the tool.

Once the tool has been pushed to its fully extended state, as illustrated in FIG. 3, locking means E is automatically actuated by locking tab 82 engaging with notch 84 to lock the tool into the extended position. As indicated in FIG. 10, to unlock an implement, the user pulls the locking tab 82 outwardly while simultaneously pulling against button 54 to retract the tool within the handle.

Figure 11:
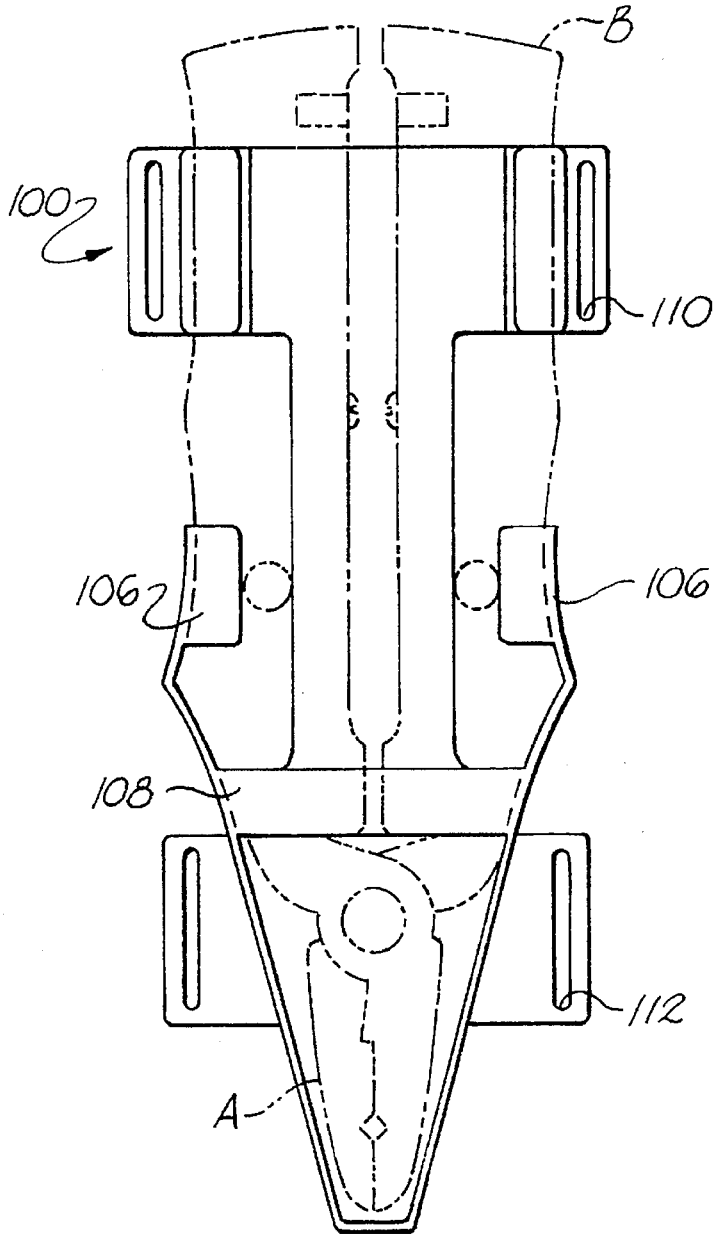
FIG. 11 is an elevational view of a sheath for carrying a multi-purpose tool constructed in accordance with the present invention, when such tool is an assembled state.
Figure 12:
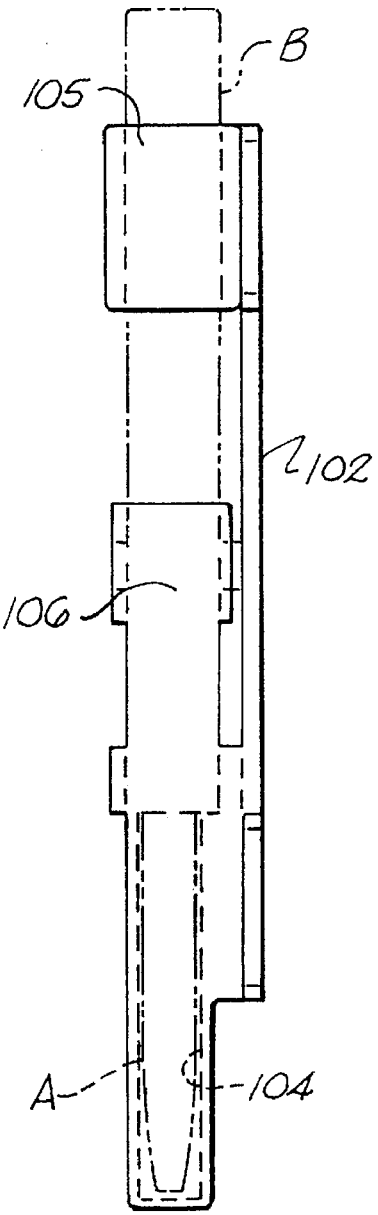
FIG. 12 is a side elevational view of the sheath illustrated in FIG. 11.

FIG. 11 illustrates a sheath 100 for carrying a multi-purpose tool in its fully assembled state. The sheath includes a body member 102 which extends longitudinally and substantially the length of the tool 10. A pincer implement chamber 104 is provided in one end of the sheath for receiving the pincer implement portion A of the tool, and spring biased tabs 106 are provided on each side of body member 102 for engaging with concave grip portions of the tool 10 handles. Guide flanges 105 are also provided on each side of body member 102 for guiding handles B into sheath 100. The tabs 106 are resilient and are inwardly biased such that when the tool 10 is inserted into the sheath, wherein the pincer implement is received in chamber 104, the tabs 106 automatically spring inwardly to grasp the handle and hold the tool 10 securely in the sheath.

To extract the tool from the sheath, the user simply grasps the tool by the handles and pulls upwardly to overcome the inward spring bias of the tabs 106. A bracing member 108 is also provided which connects the two spring tabs 106 together. Upper and lower belt or strap loops 110, 112, respectively, are also provided for allowing the sheath to be carried by belts or straps attached to the user, or some other object. While chamber 104 is shown as being opened, it is to be understood that it could be fully enclosed if desired for protecting the pincer implement A. Sheath 100 is preferably molded of resilient plastic material, but could be produced from any other suitable material.

Figure 13:
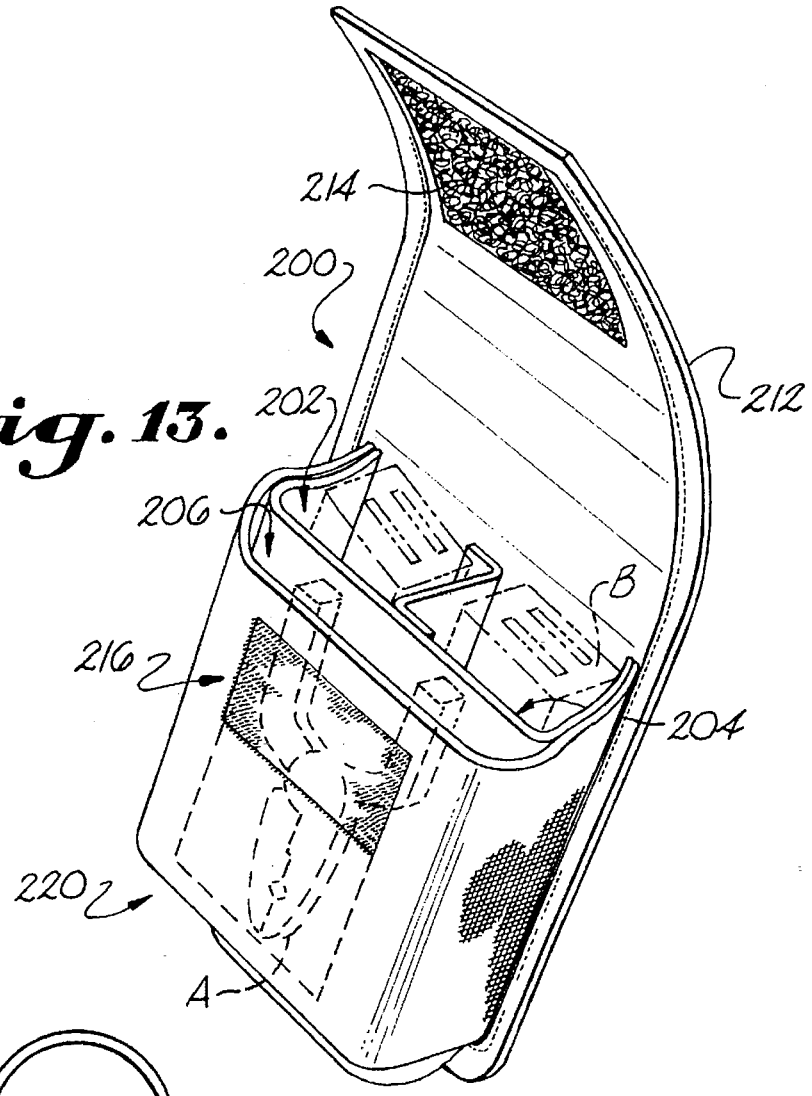
FIG. 13 is a perspective view of a sheath for carrying a multi-purpose tool constructed in accordance with the present invention, when such tool is partially disassembled.
Figure 14:
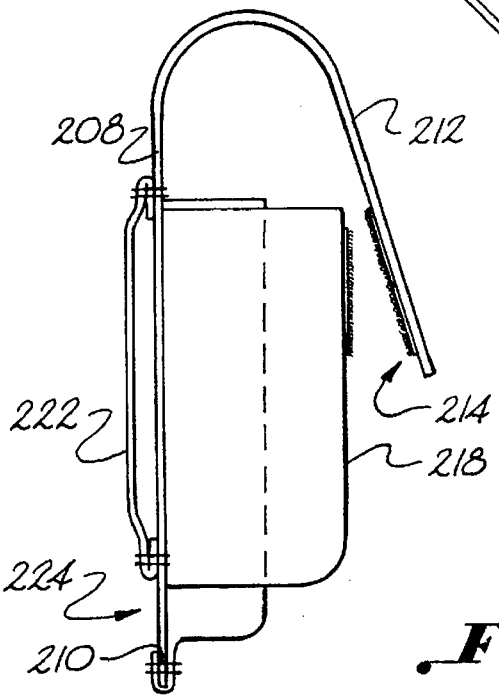
FIG. 14 is a side elevational view of the sheath illustrated in FIG. 13.

Turning to FIGS. 13 and 14, a different type of sheath 200 for carrying a multi-purpose tool 10 is illustrated. Sheath 200 includes three compartments 202, 204, and 206. Compartments 202 and 204 are configured for carrying handle members B, when such are detached from pincer implement A. Compartment 206 is configured for carrying the pincer element A, when separated from handles B. Sheath 200 is illustrated as being constructed of fabric material, although it is to be understood that it could also be molded from plastic or constructed of some other suitable material. A body member 208 extends from the base 210 of the sheath and terminates in a flap portion 212 which may be brought over compartments 202, 204, and 206 to cover the compartments, when desired. At the extreme end of the flap portion 212, a cooperating fastening system, generally 214, such as VELCRO is provided for engaging with a counterpart 216 of the fastening system on the face 218 of the sheath, which is adjacent compartment 206. Instead of Velcro, other cooperating fasteners, such as snaps, buttons, or the like could also be used. The generally pouch-shaped structure 220 which carries pliers head A and which also encloses compartments 202, 204 provides for a compact arrangement of the tool 10 when tool 10 is disassembled. A belt or strap loop 222 is also provided on sheath 200, on the back side 224 of the body portion, to allow the sheath 200 to be easily carried by the user on a belt or strap, or to allow the sheath to be attached to another object.

From the foregoing, it can be seen that the multi-purpose tool 10 of the present invention provides for pliers, or another pincer implement, to be provided and quickly used without requiring unfolding manipulations. Also, the detachable handles allow for comfortable and substantially balanced handpieces for holding and using implements slidingly provided therein. Further, because the implements slide into and out of the handle, instead of pivoting outwardly therefrom, large, open compartments on the handles are not required, thereby providing an ergonomic design which aids in the comfortable use of tool 10 when assembled and also in the comfortable use of the handles when tool 10 is disassembled.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A hand tool comprising:

first and second elongated handle members each having a first end and a second end opposite said first end; said first end of each handle member defining a pincer implement receiver and said second end of said first handle member defining a handle implement passage, and said first handle member defining an implement compartment in communication with said handle implement passage;

a pincer implement having first and second outwardly extending free ends, each of said first and second free ends being connectable to a respective one of said pincer implement receivers of said handle members;

a first locking member associated with each of said pincer implement receivers for selectively locking each of said first and second free ends to a respective one of said pincer implement receivers such that said handle members are moveable for operating said pincer implement;

at least one sliding implement carried for sliding movement in said implement compartment; said sliding implement being moveable between an extended position, extending through said handle implement passage outwardly from said handle member, and a retracted position, wherein said sliding implement is substantially within said handle member;

a second locking member associated with said first handle member and configured for selectively locking said sliding implement to said first handle member in said retracted position through engagement with said first handle member; and a latch spring associated with both said first and second locking members for biasing said first locking member towards a respective one of said pincer implement receivers, and for biasing said second locking member towards said sliding implement.

2. A hand tool comprising:

first and second elongated handle members each having a first end and a second end opposite said first end; said first end of each handle member defining a pincer implement receiver and said second end of said first handle member defining a handle implement passage, and said first handle member defining an implement compartment in communication with said handle implement passage;

a pincer implement having first and second outwardly extending free ends, each of said first and second free ends being connectable to a respective one of said pincer implement receivers of said handle members;

a first locking member associated with each of said pincer implement receivers for selectively locking each of said first and second free ends to a respective one of said pincer implement receivers such that said handle members are moveable for operating said pincer implement;

at least one sliding implement carried for sliding movement in said implement compartment; said sliding implement being moveable between an extended position, extending through said handle implement passage outwardly from said handle member, and a retracted position, wherein said sliding implement is substantially within said handle member;

a second locking member associated with said first handle member and configured for selectively locking said sliding implement to said first handle member in said retracted position through engagement with said first handle member; and a tool set having said pincer implement, said handles, and at least one tool member; and wherein said pincer implement receiver of said first handle defines a socket for selectively receiving said tool member or said pincer implement, such that upon receipt of said tool member in said socket, said tool member becomes operative through manipulation of said handle member.

3. A hand tool as defined in claim 2, wherein said first locking member locks said tool member in said socket of said handle member.

* * * * *